US007217081B2

(12) United States Patent
Scheurlen et al.

(10) Patent No.: US 7,217,081 B2
(45) Date of Patent: May 15, 2007

(54) COOLING SYSTEM FOR A SEAL FOR TURBINE VANE SHROUDS

(75) Inventors: Michael Scheurlen, Orlando, FL (US); Xubin E. Gu, Orlando, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 76 days.

(21) Appl. No.: 10/966,471

(22) Filed: Oct. 15, 2004

(65) Prior Publication Data

US 2006/0083620 A1 Apr. 20, 2006

(51) Int. Cl.
*F01D 11/00* (2006.01)
*F01D 9/04* (2006.01)
*F01D 9/06* (2006.01)
*F01D 25/12* (2006.01)

(52) U.S. Cl. ..... 415/1; 415/115; 415/116; 415/139; 415/180; 415/191; 277/642; 277/643; 277/644; 277/930

(58) Field of Classification Search ..... 415/1, 415/115, 116, 135, 136, 138, 139, 180, 170.1, 415/191; 277/641–644, 630, 930
See application file for complete search history.

(56) References Cited

U.S. PATENT DOCUMENTS 3,393,894 A * 7/1968 Redsell ..... 415/115
3,752,598 A 8/1973 Bowers et al.
3,801,220 A 4/1974 Beckershoff
4,465,284 A 8/1984 Szema
4,702,670 A 10/1987 Winter
4,767,260 A 8/1988 Clevenger et al.
4,872,812 A 10/1989 Hendley et al.
4,902,198 A * 2/1990 North ..... 415/115
5,167,485 A 12/1992 Starkweather
5,374,161 A 12/1994 Kelch et al.
5,531,457 A 7/1996 Tibbott et al.
5,599,170 A 2/1997 Marchi et al.
6,565,322 B1 5/2003 Lieser et al.
6,682,307 B1 1/2004 Tiemann
6,692,227 B2 2/2004 Tomita et al.

FOREIGN PATENT DOCUMENTS

GB 2195403 A * 4/1988 ..... 415/113

* cited by examiner

*Primary Examiner*—Christopher Verdier

(57) ABSTRACT

A seal for sealing a seal groove in a shroud of a turbine vane. The seal may include a cooling system configured to pass cooling fluids through a cooling fluid supply port in a shroud, through a cooling system in which the cooling fluids contact the shroud and the seal, and exhaust the fluids through a gap between adjacent turbine vanes. The seal may include an elongated cooling channel for channeling cooling fluids from a supply to an exhaust channel at a first end. The cooling system may remove heat from the turbine vane shroud, the seal, and other related components, thereby reducing the likelihood of premature failure.

11 Claims, 2 Drawing Sheets

COOLING SYSTEM FOR A SEAL FOR TURBINE VANE SHROUDS

FIELD OF THE INVENTION

This invention is directed generally to turbine vanes and, more particularly, to turbine vane shroud assemblies.

BACKGROUND

Typically, gas turbine engines operate at high temperatures that may exceed 2,500 degrees Fahrenheit. During operation, turbine engines expose turbine vanes, turbine vane shrouds, and other components to these high temperatures. As a result, turbine vanes and shrouds must be made of materials capable of withstanding such high temperatures. Turbine vanes often contain cooling systems for prolonging the life of the vanes and reducing the likelihood of failure as a result of excessive temperatures. However, these cooling systems often do not include cooling channels for reducing the temperature of seals positioned in seal grooves between adjacent turbine vanes in turbine shrouds. Without adequate cooling, these seals are susceptible to premature failure. Thus, a need exists for a cooling system for seals in seal grooves of turbine vane shrouds to reduce the likelihood of premature failure.

SUMMARY OF THE INVENTION

This invention relates to a seal for sealing gaps between adjacent turbine vane shrouds in a turbine engine. The seal may include a cooling system for removing heat from a turbine vane, a turbine vane shroud, and a seal to prevent premature failure. The seal may, in at least one embodiment, be formed from an elongated body configured to fit within seal grooves on side surfaces of turbine vane shrouds. The seal grooves may be configured such that a seal groove on a first turbine vane shroud is configured to receive about half of a seal, and a recess in a second turbine vane shroud positioned proximate to the first turbine vane shroud is configured to receive the remainder of the seal. In at least one embodiment, the seal may be formed from a first end and a second end generally opposite the first end, a top surface and a bottom surface generally opposite the top surface, and a first side surface and a second side surface generally opposite the first side surface.

The cooling channel may extend generally parallel to a longitudinal axis of the elongated body on an outer surface of the elongated body. In at least one embodiment, the cooling channel may extend generally from a midpoint between the first and second ends to the first end. The cooling channel, in at least one embodiment, may contact a first side surface and a top surface of the elongated body forming a generally rectangular cooling channel. The cooling channel may be formed on two sides by the seal and on two sides by the turbine vane shroud. The cooling channel may extend to the first end of the elongated body where it may contact an exhaust channel. The exhaust channel may, in at least one embodiment, extend the width of the elongated body and provide a flow path for cooling fluids to be exhausted from the cooling system.

During operation of a turbine engine, hot combustion gases pass turbine vanes and turbine vane shrouds, which cause these components to increase in temperature. Cooling fluids may be passed through the cooling system in the seal to remove heat from the turbine vane, the turbine vane shroud, and the seal to prevent premature failure of the components. The cooling fluids may be passed through a cooling fluid supply port in the shroud and into a cooling fluid supply orifice in the seal. The cooling fluids may flow through the cooling channel and remove heat from walls of the cooling channel. The cooling fluids may collect in the exhaust channel and be exhausted from the cooling system through a gap between adjacent turbine vane shrouds.

Also disclosed is a method of removing heat from a turbine vane shroud, comprising passing a cooling fluid through an orifice in the turbine vane shroud; passing the cooling fluid into a cooling channel of a cooling system in a seal in the turbine vane shroud such that the cooling fluid flows from midchord to a leading edge of the turbine vane shroud along a longitudinal axis of the seal, whereby the seal comprises an elongated body having an exterior shape capable of fitting inside a seal groove on the shroud of the turbine vane; a cooling channel on the elongated body extending on an outer surface of the elongated body generally parallel to the longitudinal axis of the elongated body; a cooling fluid supply orifice in communication with the cooling channel; and wherein the cooling channel extends generally from a first side surface about halfway toward a second side surface of the elongated body and extends from a midpoint of the elongated body to a first end of the elongated body; and exhausting the cooling fluid from the cooling channel through a gap between adjacent turbine vane shrouds.

An advantage of this invention is that the cooling fluids remove heat and reduce the temperature of the surrounding components, thereby substantially reducing the risk of premature failure of the components.

Another advantage of this invention is that the cooling system improves cooling of the seal groove and reduces hot spot formation in various components of a turbine vane.

Yet another advantage of this invention is that as cooling fluids are exhausted from the gap between adjacent shrouds, the cooling fluids my reduce the temperature of the external side of the seal from the leading edge to the trailing edge of the seal.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
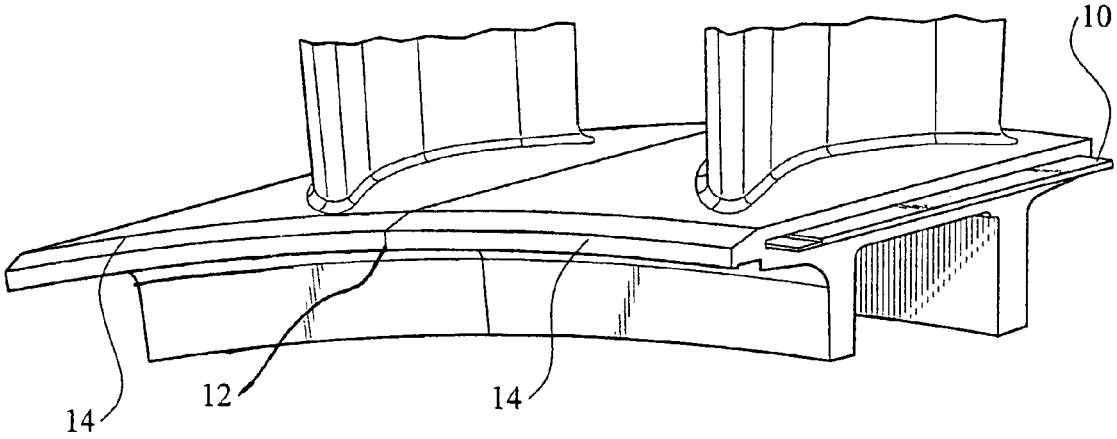
FIG. 1 is a perspective view of turbine vane shrouds including aspects the invention.

As shown in FIGS. 1–4, this invention is directed to a seal 10 for sealing gaps 12 between turbine vane shrouds 14, which may also be referred to as shroud segments that collectively form a shroud in a turbine engine. The seal 10 includes a cooling system 16 for removing heat from the seal 10 to prevent premature failure of the seal 10, the turbine vane shroud 14, and the turbine vane. The cooling system 16 may be configured to receive cooling fluids, which may be, but are not limited to, air, from one or more cooling fluid supply ports 18, pass the cooling fluids through the cooling system 16, and exhaust the cooling fluids through a gap 12 between adjacent turbine vane shrouds 14.

Figure 2:
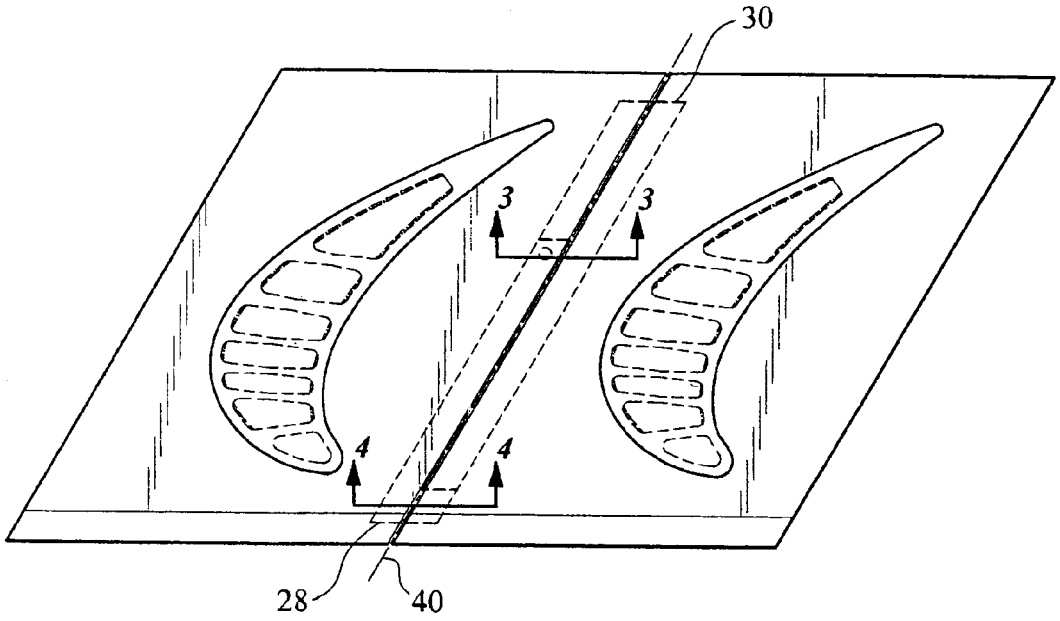
FIG. 2 is a top plan view of a seal of the invention.
Figure 3:
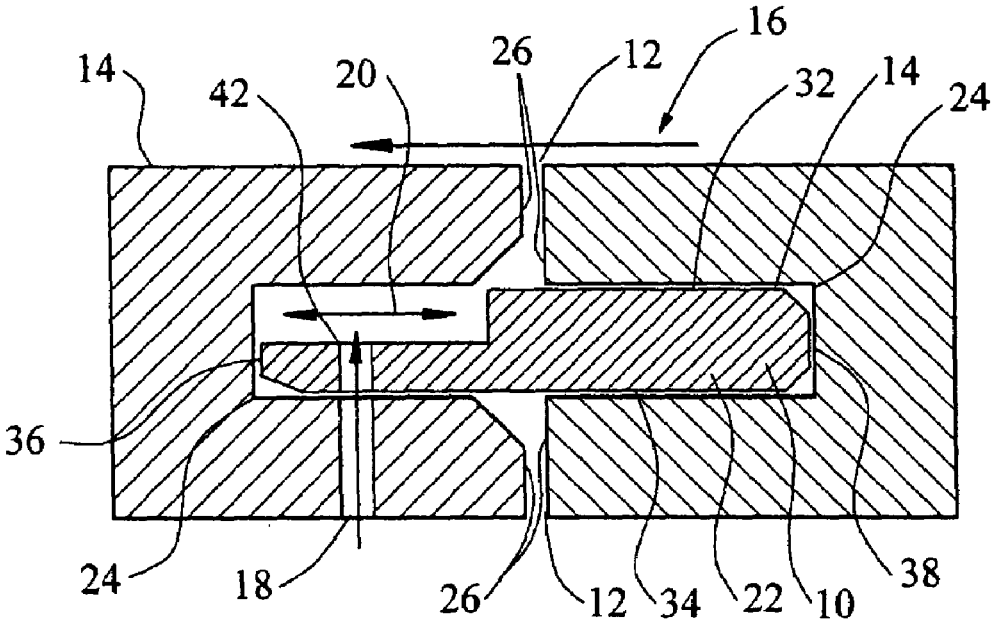
FIG. 3 is a cross-sectional detail view of the seal and adjacent turbine vane shrouds shown in FIG. 2 taken at detail 3—3.
Figure 4:
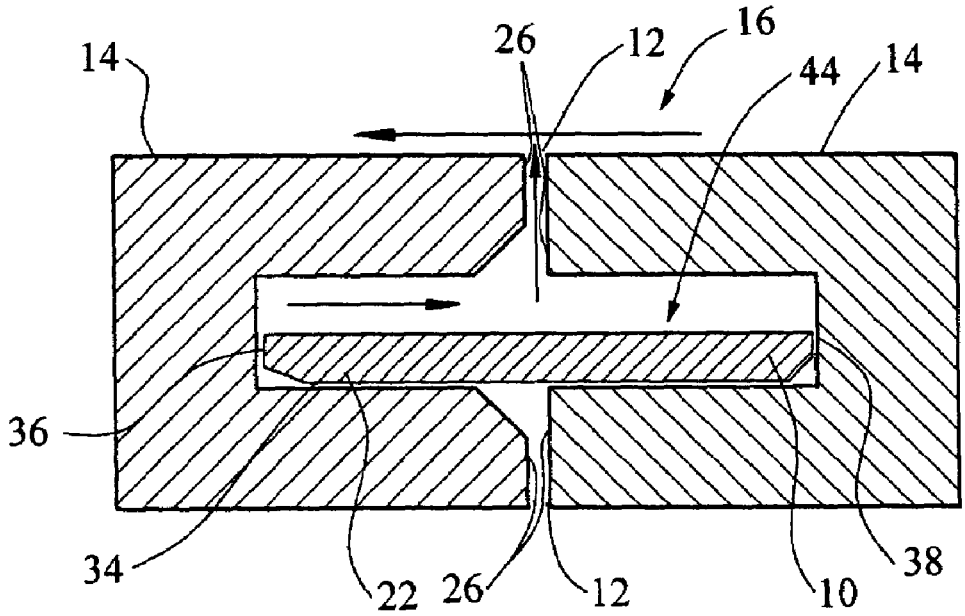
FIG. 4 is a cross-sectional detail view of the seal and adjacent turbine vane shrouds shown in FIG. 2 taken at detail 4—4.

As shown in FIG. 2, the seal 10 may be formed from an elongated body 22 configured to fit into seal grooves 24 on side surfaces 26 of the turbine vane shrouds 14. The seal 10, as shown in FIGS. 2 and 3, may have a first end 28 and a second end 30 generally opposite the first end 28, a top surface 32 and a bottom surface 34 generally opposite the top surface 32, and a first side surface 36 generally orthogonal to the top surface 32 and a second side surface 38 generally opposite the first side surface 36. Corners of the elongated body 22 may or may not be filleted or tapered, as shown in FIGS. 3 and 4. A cooling channel 20 may be formed on a portion of the top surface 32 and a portion of the first side surface 36. In at least one embodiment, the cooling channel 20 may form a generally rectangular shape formed by portions of the seal 10 and the turbine vane shroud 14. The cooling channel 20 may extend generally along, or parallel to, a longitudinal axis 40 of the elongated body 22. In at least one embodiment, the cooling channel 20 extends substantially from a midpoint of the elongated body 22 to the first end 28. The cooling channel 20 may extend generally midway into the elongated body between the top surface 32 and the bottom surface 34. In addition, the cooling channel 20 may extend from a first side surface 36 about half way toward a second side surface 38. The cooling channel 20 is not limited to the this configuration but may include other appropriate configurations capable of channeling cooling fluids through the turbine vane shroud 14 to reduce the temperature of the shroud 14 and the seal 10. In other embodiments, the cooling channel 20 may have other lengths, widths, or depths.

The seal 10 may also include a cooling fluid supply orifice 42 for supplying cooling fluids to the cooling channel 20. The cooling fluid supply orifice 42 may extend generally orthogonal to the bottom surface 34 and terminate at the top surface 32 of the cooling channel 20. In other embodiments, the cooling fluid supply orifice 42 may have other configurations. The cooling fluid supply orifice 42 may be aligned with the cooling fluid supply port 18 such that cooling fluids may flow from the cooling fluid supply port 18 into the cooling fluid supply orifice 42 and then into the cooling channel 20. The cooling fluid supply orifice 42 may be sized based on the anticipated flow rate of cooling fluids necessary to achieve sufficient heat removal from the shroud 14 and the seal 10. The cooling fluid supply orifice 42 may be, but is not limited to being, generally circular. The cooling fluid supply orifice 42 may have other appropriate configurations as well.

The cooling system 16 may also include an exhaust channel 44 coupled to the cooling channel 20 for exhausting cooling fluids from the cooling system 16. The exhaust channel 44 may exhaust gases between a gap 12 between adjacent turbine vane shrouds 14. In at least one embodiment, as shown in FIG. 4, the exhaust channel 44 may extend the width of the elongated body 22 forming the seal 10. The exhaust channel 44 may have a depth substantially equal to a depth of the cooling channel 20. The exhaust channel 44 may extend into the elongated body 22 a distance sufficient to enable the exhaust channel 44 to collect cooling and exhaust the cooling fluids from the cooling system 16. In other embodiments, the exhaust channel 44 may have other widths, heights, and depths.

During operation of a turbine engine, hot combustion gases flow past turbine vane assemblies and increase the temperature of turbine vanes and turbine vane shrouds 14. Cooling fluids, such as, but not limited to, air, may be passed through the cooling system 16 to remove heat from the turbine vane shroud 14, the turbine vane, and the seal 10 to prevent premature failure. Cooling fluids may be injected into the cooling system 16 through a cooling fluid supply port 18. The cooling fluids may flow from the cooling fluid supply port 18 and into the cooling fluid supply orifice 42. The cooling fluids flow from the cooling fluids supply orifice 42 into the cooling channel 20 where the cooling fluids contact surfaces of the seal 10 and a turbine vane shroud 14. In this manner, the cooling fluids flow from midchord of the turbine vane to a leading edge along the seal 10. The cooling fluids remove heat from the turbine vane shroud 14 by convection and flow from the cooling fluid supply orifice 42 toward the first end 28. As the cooling fluids flow toward the first end 28, the cooling fluids increase in temperature. The cooling fluids collect in the exhaust channel 44 at the first end 28 and are exhausted from the cooling system 16 through the gap 12 between adjacent turbine vane shrouds 14.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A seal for sealing gaps between adjacent turbine vane shrouds, comprising:

an elongated body having an exterior shape capable of fitting inside a seal groove on a shroud of a turbine vane;

a cooling channel on the elongated body extending on an outer surface of the elongated body generally parallel to a longitudinal axis of the elongated body, wherein the cooling channel is formed by the elongated body and the shroud when the seal is installed in the seal groove of the turbine vane shroud;

a cooling fluid supply orifice extending through the elongated body and in communication with the cooling channel;

wherein the cooling channel extends generally from a first side surface about half way toward a second side surface of the elongated body and extends from a midpoint of the elongated body to a first end of the elongated body.

2. The seal of claim 1, further comprising an exhaust channel coupled to the cooling channel and configured to exhaust cooling fluids from the cooling channel through a gap between adjacent turbine vane shrouds.

3. The seal of claim 2, wherein the exhaust channel extends a width of the elongated body.

4. The seal of claim 1, wherein the cooling fluid supply orifice extends generally orthogonal to a bottom surface of the elongated body.

5. The seal of claim 1, wherein the cooling fluid supply orifice corresponds with a cooling fluid supply port in a seal groove of a turbine vane into which the seal is configured to be inserted.

6. The seal of claim 1, wherein the cooling channel has a width that enables the elongated body to seal a gap between adjacent turbine vane shrouds.

7. A seal for sealing gaps between adjacent turbine vane shrouds, comprising:

an elongated body having an exterior shape capable of fitting inside a seal groove on a shroud of a turbine vane, a first end, a second end generally opposite the first end, a top surface, a bottom surface generally opposite the top surface, a first side surface, and a second side surface generally opposite the first side surface;

a cooling channel on the elongated body extending generally parallel to a longitudinal axis of the elongated body on an outer surface of the elongated body, wherein the cooling channel is in contact with the first side surface and the top surface;

a cooling fluid supply orifice extending through the elongated body and in communication with the cooling channel;

wherein the cooling channel extends generally from the first side surface about halfway toward the second side surface of the elongated body and extends from a midpoint of the elongated body to the first end of the elongated body.

8. The seal of claim 7, further comprising an exhaust channel coupled to the cooling channel and configured to exhaust cooling fluids from the cooling channel through a gap between adjacent turbine vanes.

9. The seal of claim 8, wherein the exhaust channel extends a width of the elongated body.

10. The seal of claim 7, wherein the cooling fluid supply orifice corresponds with a cooling fluid supply port in a seal groove of a turbine vane into which the seal is configured to be inserted.

11. A method of removing heat from a turbine vane shroud, comprising:

passing a cooling fluid through an orifice in the turbine vane shroud;

passing the cooling fluid into a cooling channel of a cooling system in a seal in the turbine vane shroud such that the cooling fluid flows from midchord to a leading edge of the turbine vane shroud along a longitudinal axis of the seal, whereby the seal comprises:

an elongated body having an exterior shape capable of fitting inside a seal groove on the shroud of the turbine vane;

a cooling channel on the elongated body extending on an outer surface of the elongated body generally parallel to the longitudinal axis of the elongated body;

a cooling fluid supply orifice in communication with the cooling channel; and wherein the cooling channel extends generally from a first side surface about halfway toward a second side surface of the elongated body and extends from a midpoint of the elongated body to a first end of the elongated body; and exhausting the cooling fluid from the cooling channel through a gap between adjacent turbine vane shrouds.

* * * * *